United States Patent [19]

Booth

[11] 4,017,019

[45] Apr. 12, 1977

[54] PAPERBOARD CONTAINER

[75] Inventor: Vernard S. Booth, Albany, Ga.

[73] Assignee: Olinkraft, Inc., West Monroe, La.

[22] Filed: Apr. 5, 1976

[21] Appl. No.: 673,850

[52] U.S. Cl. ..... 229/39 R; 229/52 B

[51] Int. Cl.[2] ..... B65D 5/10; B65D 5/46

[58] Field of Search ..... 229/39 R, 52 B

[56] References Cited

UNITED STATES PATENTS

| | | | |
|---|---|---|---|
| 1,987,063 | 1/1935 | Hinton | 229/52 B |
| 2,398,797 | 4/1946 | Meyer et al. | 229/39 R |
| 2,625,315 | 1/1953 | Fehremkamp | 229/39 R |
| 2,713,965 | 7/1955 | Acker | 229/39 R |
| 2,916,195 | 12/1959 | Gatward | 229/52 B |
| 3,018,029 | 1/1962 | Fellowes | 229/39 R |
| 3,140,811 | 7/1964 | Hall et al. | 229/52 B X |

FOREIGN PATENTS OR APPLICATIONS

| | | | |
|---|---|---|---|
| 1,063,100 | 12/1953 | France | 229/39 R |

*Primary Examiner*—Davis T. Moorhead
*Attorney, Agent, or Firm*—O'Brien & Marks

[57] ABSTRACT

A paperboard container has a bottom lock structure in which a bridging portion of a female lock panel holds a pair of buffer tabs between it and a male panel to provide a frictionally-secured bottom lock. The top of the container includes a triple thickness integral handle also locked into place by top lock means.

1 Claim, 6 Drawing Figures

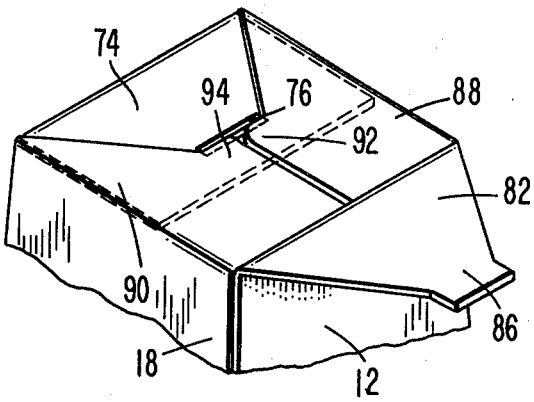
FIG. 4
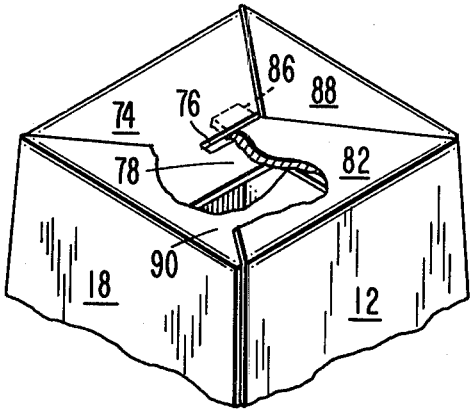
FIG. 5
FIG. 1
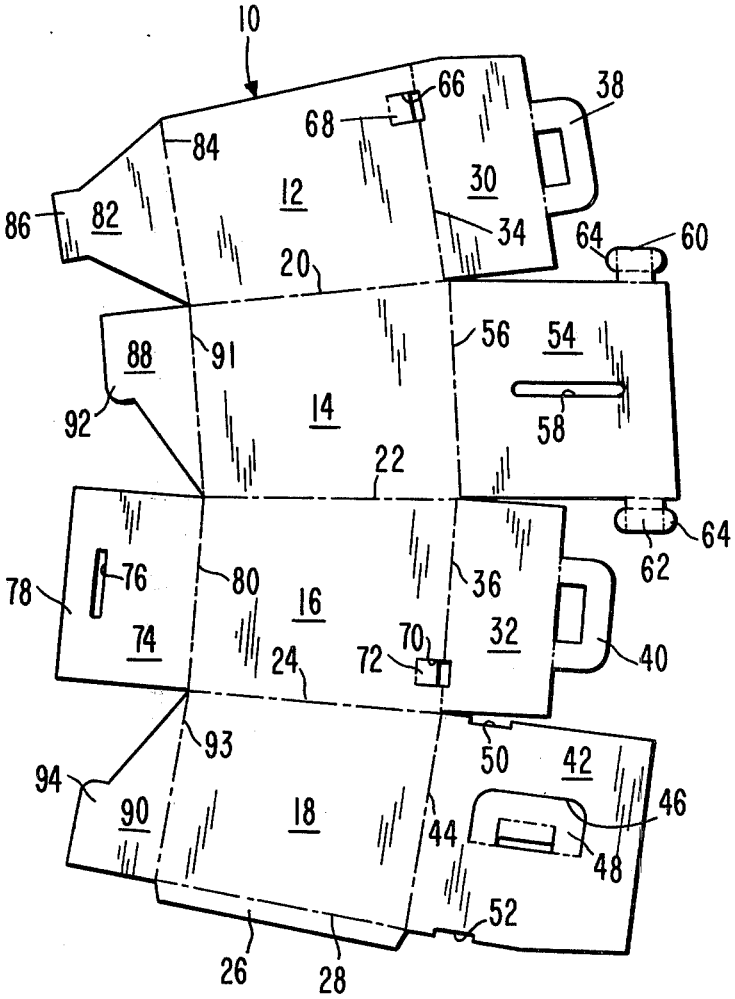

PAPERBOARD CONTAINER

BACKGROUND OF THE INVENTION

1. Field of the Invention

The present invention relates to paperboard containers and in particular to locks for holding the container together.

2. Description of the Prior Art

It is common practice in the art to assemble paperboard boxes in which the bottom is secured by inserting a male locking tab into a female slot of some kind, but it has generally been necessary to provide some form of hook or interlock on the male tab to hold the tab in place. Such hook arrangements, while satisfactory in strength, have a distinct disadvantage in that the lock is difficult to disassemble, and also, more importantly, in making it difficult or impossible for some locks to be assembled by automated equipment. Prior art disclosing hook-type or interlocking type bottom closures include U.S. Pat. No. 267,698, No. 3,104,795, No. 3,115,291 and No. 3,642,192.

SUMMARY OF THE INVENTION

The present invention is summarized in that a bottom lock for a four-sided paperboard container includes a male bottom lock panel attached to a first side of the container, a generally rectangular locking tab extending from the male bottom lock panel, first and second generally triangular buffer panels attached to the respective sides of the container adjacent the first side, a buffer tab extending from the edge of each of the buffer pads, a female bottom lock panel attached to the side of the container opposite the first side, the female bottom lock panel having an elongated rectangular locking slot defined therein, and a bridging portion formed on the female bottom lock panel separating the locking slot from the edge of the female bottom lock panel, the buffer panels being folded onto the female bottom lock panel so that the buffer tabs rest on the bridging portion, the male bottom lock panel being folded onto the buffer panels and the locking tab being inserted into the locking slot so that the bridging portion presses against the buffer tabs which press against the male bottom lock panel to hold the bottom lock secure.

An object of the present invention is to construct a stronger more stable bottom lock closure without the use of hook-type locking closures.

Another object of the present invention is to provide a bottom lock structure that can readily and efficiently be assembled by modern, automated equipment.

Yet another object of the present invention is to provide a paperboard container having great bottom strength and an integral extremely strong handle so that it can be used for very heavy loads.

Other objects, features and advantages of the present invention will become apparent from the following description when taken in conjunction with the accompanying drawings.

BRIEF DESCRIPTION OF THE DRAWINGS

FIG. 1 is a plan view of a paperboard blank from which a container embodying the present invention can be constructed.

FIG. 4 is a view similar to FIG. 3 after a further assembly step.

FIG. 5 is a view similar to FIG. 4 with a part broken away.

DESCRIPTION OF THE PREFERRED EMBODIMENT

Figure 6:
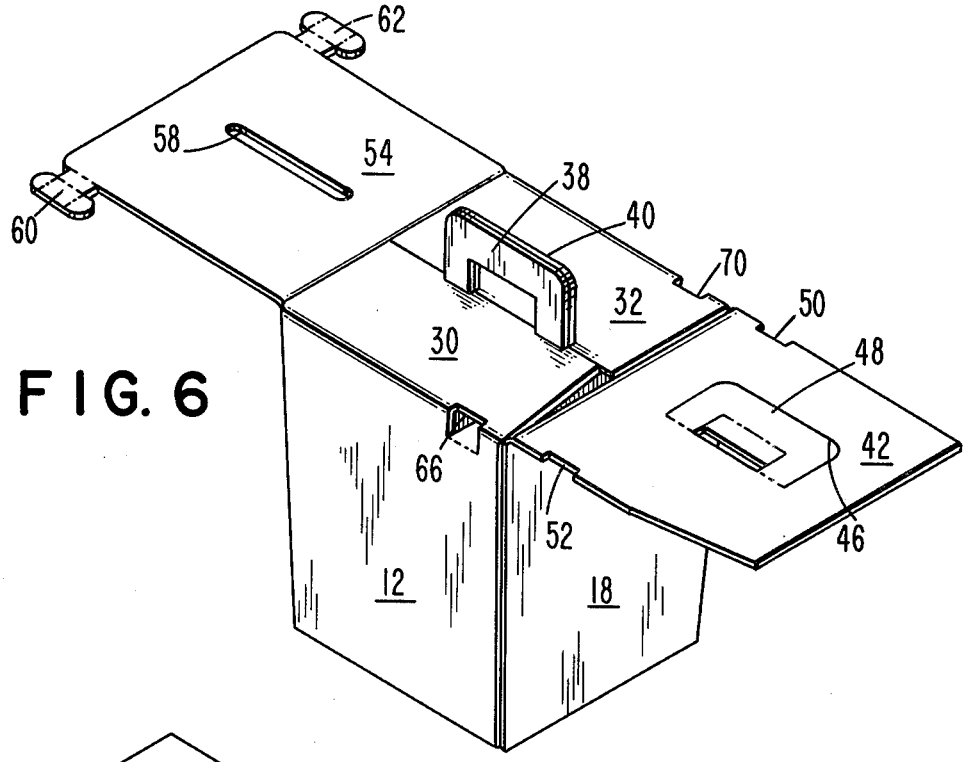
FIG. 6 is a perspective view of the partially assembled top portion of the container constructed from the blank of FIG. 1.

As shown in FIG. 1, the present invention is embodied in a corrugated paperboard blank 10 from which a paperboard container is constructed. The blank 10 includes wall panels 12, 14, 16, and 18 joined by respective score lines 20, 22 and 24. The wall panels 12, 14, 16 and 18 are of a similar, generally trapezoidal shape with the joining scorelines being on the non-parallel sides of the trapezoids. Attached to the edge of the wall panel 18 opposite from the wall panel 16 is a joiner flap 26 attached to the wall panel 18 by a scoreline 28.

Extending from the long parallel sides of the trapezoids of the wall panels 12 and 16 are top half-panels 30 and 32 separated from the wall panels 12 and 16 by scorelines 34 and 36. Extending from the edges of the top half-panels 30 and 32 opposite from the scorelines 34 and 36 are handle panel flaps 38 and 40. Attached to the long parallel side of the trapezoid of the wall panel 18 is a top panel 42 joined to the wall panel 18 by a scoreline 44. A handle die cut 46 in the top panel 42 defines a foldable handle panel flap 48 in the top panel 42. Cut into opposite side edges of the top panel 42 are top-lock cut-outs 50 and 52. Along the long side of the trapezoid of the wall panel 14 a top panel 54 is secured to the wall panel 14 by a scoreline 56. An elongated die-cut handle slot 58 is centrally formed in the top panel 54. Formed on and extending from opposite side edges of the top panel 54 are locking fingers 60 and 62. Each of the locking fingers 60 and 62 has formed on the opposite edge of its extreme ends a pair of foldable locking tips 64. A top lock recess 66 is formed by a die-cut into both the wall panel 12 and the top half-panel 30. A push-in flap 68 extends into the top lock recess 66 from the end wall panel 12. Similarly a top lock recess 70 cut into the wall panel 16 and the top-panel 32 receives therein a push-in flap 72 extending from the wall panel 16.

Attached along the short parallel side of the trapezoid of the side wall panel 16 is a female bottom lock panel 74. The bottom lock panel 74 has formed in it an elongated rectangular locking slot 76. The locking slot 76 is separated from the edge of the bottom lock panel 74 opposite the wall panel 16 by a bridging portion 78. The bottom lock panel 74 is joined to the wall panel 16 by a scoreline 80. Extending from the short parallel side of the wall panel 12 is a male bottom lock panel 82 joined to the wall panel 12 by a scoreline 84. The bottom lock panel 82 has the general shape of an acute equilateral triangle with the long side of the triangle lying along the scoreline 84. A male locking tab 86 extends outward from the bottom lock panel 82 where the apex of the triangle would be. The locking tab 86 is of a generally rectangular shape of a width very slightly smaller than the width of the locking slot 76 in the bottom lock panel 74. Attached to each of the wall panels 14 and 18 are respective bottom lock buffer panels 88 and 90 joined to the wall panels 14 and 18 by scorelines 91 and 93. The buffer panels 88 and 90 are of the general shape of acute right triangles with the acute angles arranged adjacent the bottom lock panel 74. Each of the buffer panels 88 and 90 also has formed thereon one of respective rounded extended buffer tabs 92 and 94. The buffer tabs 92 and 94 extend from the long sides of the triangles adjacent the extreme ends of the buffer panels 88 and 90.

In the assembly of an erected container from the blank 10, the wall panels 12, 14, 16 and 18 are first folded relative to each other along the scorelines 20, 22 and 24. The joiner flap 26 is then folded along the scoreline 28 and is secured to the wall panel 12 in an conventional, known manner and can be fastened either to the exterior of the wall panel 12, or can be tucked inside and fastened to the inside surface of the wall panel 12.

Figure 2:
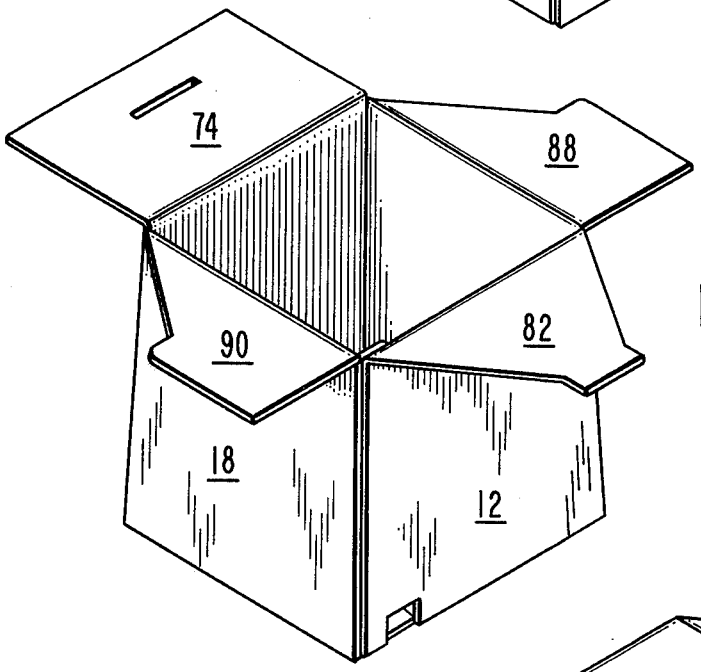
FIG. 2 is an inverted perspective view of the bottom of a partially erected container from the blank of FIG. 1.
Figure 3:
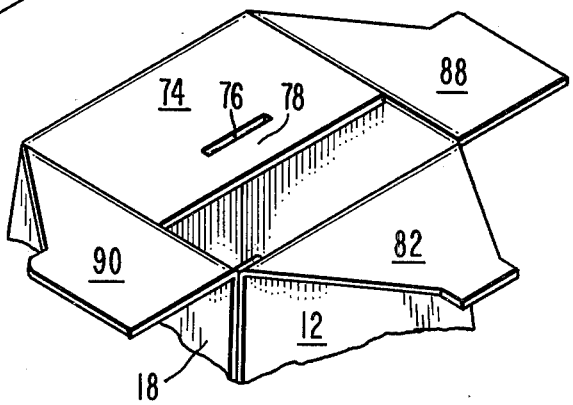
FIG. 3 is a view similar to FIG. 2 after an assembly step.

The method of closing the bottom lock of the container is shown in sequence in FIGS. 2 through 5. FIG. 2 shows the bottom of the container, after the joiner flap has been secured, with the bottom lock panels 74 and 82 and the buffer panels 88 and 90 folded back out of the way to allow a clear view of the bottom lock construction. First, as shown in FIG. 3, the bottom lock panel 74 is folded along the scoreline 80 into the open bottom of the container. Then, as seen in FIG. 4, the buffer panels 88 and 90 are folded over along the scorelines 91 and 93. This folding brings the buffer panels 88 and 90 into flat abutting contact with the bottom lock panel 74. The buffer tabs 92 and 94 are sized and positioned on the buffer panel 88 and 90 so that the buffer tabs 92 and 94 rest directly on the bridging portion 78 and extend up to and adjacent the locking slot 76. Then the bottom lock panel 82 is folded over along the scoreline 84. The locking tab 86 is inserted into the locking slot 76 as is shown in FIG. 5.

The insertion of the locking tab 86 into the locking slot 76 locks the bottom of the container in position securely and positively without the need of any hooking-style locking elements on the locking tab 86. At all times when the bottom is secured the buffer tabs 92 and 94 are pinned in between the bridging portion 78 of the bottom lock panel 74 and the bottom lock panel 82. This forces the locking tab 86 upward (as seen in FIG. 5) against the inside surface of the bottom lock panel 74 thereby creating a frictional holding force sufficient to resist the withdrawal of the locking tab 86. This force is created by the bridging portion 78 which, because it is directly adjacent the locking slot 76 translates any force on the bottom lock panel 74 or on the locking slot 76 into a similar pressure against the buffer tabs 92 and 94 and thereby against the bottom lock panel 82. This action is accentuated by loading of the container. The weight of the contents of the container would press (assuming the container has been righted) downward against the bottom lock panel 74 and the buffer panels 88 and 90 thereby further pressing against the bottom lock panel 82 and forcing the locking tab 86 against the inside surface of the bottom lock panel 74. Thus a secure bottom lock is constructed that is retained in place entirely by frictional forces and requires no lock-type or other complex interlocking features to retain the bottom in place. Because this lock functions without the use of hook-style locking elements, the lock can also be much more easily constructed in that it can more readily be assembled by an automated machine than previously known locks, thereby resulting in a great cost savings.

The method of construction of the top of the container is illustrated by FIG. 6. First the two top half-panels 30 and 32 are folded inward along the scorelines 34 and 36 and the handle panel flaps 38 and 40 are folded upward from the top-half panels 30 and 32 as they are folded. This causes the handle panel flaps 38 and 40 to be aligned lying abutting in a vertical orientation above and perpendicular to the top half-panels 30 and 32. Then the top panel 42 is folded over along the scoreline 44 with the handle panel flap 48 folded perpendicular to the top panel 42. The handle panel flaps 38 and 40 project into the recess created by the die-cut 46 in the top panel 42 and the handle panel flap 48 lies next to the handle panel flaps 38 and 40 when the top flap 42 is fully folded, thereby creating a triple thickness handle. Then the top panel 54 is folded over along the scoreline 56. The triple thickness handle formed from handle panel flaps 38, 40 and 48 is received through the handle slot 58 as the top panel 54 is folded. Then the locking fingers 60 and 62 are folded down into the top lock cut-outs 50 and 52. Pressure is then applied to the ends of the locking fingers 60 and 62 forcing them into the top-lock recesses 66 and 70. The push-in flaps 68 and 72 are pushed out of the way by the insertion pressure on the locking fingers 60 and 62. The locking tips 64 on both of the locking fingers 60 and 62 prevents the locking fingers 60 and 62 from being inadvertently withdrawn from the top-lock recesses 66 and 70.

Thus a secure, locked top is formed on the container with an integral triple-thickness handle formed in it for easy transportion of the container with little danger of tearing of the handle. The locking fingers 60 and 62 secure all the top flap elements in position fixing the top closure of the container in a secure position. The provision of the top-lock cut-outs 50 and 52 together with the extension of the top-lock recesses 66 and 70 into the top half panels 30 and 32 allows the locking fingers 60 and 62 to be folded straight downward from the top panel 54 to make the top lock especially resistant to inadvertant unlocking.

Inasmuch as the present invention is subject to many changes, modifications and variations in detail, it is intended that all the material in the aforegoing specification or in the accompanying drawings be interpreted as illustrative, rather than in a limiting sense.

What is claimed is:

1. A paperboard container comprising four trapezoidal side wall panels, each joined to two adjacent side wall panels along its non-parallel sides, a bottom formed from bottom panels extending from the short parallel sides of each of the side wall panels, a handle panel flap extending from each of the top half-panels, a first top panel having a handle die cut formed therein defining a handle panel flap, the first top panel foldable over the top half-panels so that the handle panel flaps from the top half-panels and the handle panel flap from the first top panel are adjacently aligned, a second top panel having a handle slot formed therein, the second top panel foldable so that the three aligned handle panel flaps are received through the handle slot, locking means including a pair of locking fingers extending from opposite sides of the second top panel, opposite sides of the container having top-lock recesses formed therein to receive the locking fingers to secure the second top panel in position, said first top panel extending from a side of the container opposite the side from which the second top panel extends and said first top panel having top-lock cut-outs defined in opposite sides thereof to receive the locking fingers of the second top panel therein, top half-panels extending from the sides of the container in which the top-lock recesses are defined, the top-lock recesses also extending into the top half-panels so that the locking fingers can be received therein, one of said bottom panels defining a female bottom lock panel having a locking slot defined therein and a bridging portion separating the locking slot from the edge of the female bottom lock panel, a pair of said bottom panels defining a pair of buffer panels each having a buffer tab formed thereon, another of said bottom panels defining a male bottom lock panel having a locking tab extending therefrom, the buffer panels being foldable onto the female bottom lock panel so that the buffer tabs lie adjacent the bridging portion and the male bottom lock panel being foldable such that the locking tab is received in the locking slot, the bridging portion thereby holding the buffer tabs against the male bottom lock panel to secure the bottom of the container, and said locking tab being of a generally rectangular shape and being held in the locking slot by frictional forces.

* * * * *

UNITED STATES PATENT OFFICE

CERTIFICATE OF CORRECTION

Patent No. 4,017,019 Dated April 12, 1977

Inventor(s) VERNARD S. BOOTH

It is certified that error appears in the above-identified patent and that said Letters Patent are hereby corrected as shown below:

Claim 1, column 4 between lines 54 and 55 insert the following new line -- a pair of top half-panels, --;

Claim 1, column 5 line 10, before "top" insert -- said --.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*